US011578440B2

(12) United States Patent
Wendel et al.

(10) Patent No.: US 11,578,440 B2
(45) Date of Patent: Feb. 14, 2023

(54) SEWING MACHINE

(71) Applicant: Inteva Products, LLC, Troy, MI (US)

(72) Inventors: Darren Wendel, Ortonville, MI (US); Joseph Cox, Utica, MI (US); Ramez Habhab, Rochester Hills, MI (US); Edward Wenzel, Troy, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 357 days.

(21) Appl. No.: 16/689,901

(22) Filed: Nov. 20, 2019

(65) Prior Publication Data

US 2020/0157719 A1 May 21, 2020

Related U.S. Application Data

(60) Provisional application No. 62/770,422, filed on Nov. 21, 2018.

(51) Int. Cl.
*D05B 3/00* (2006.01)

(52) U.S. Cl.
CPC ..... *D05B 3/00* (2013.01)

(58) Field of Classification Search
CPC . D05B 3/00; D05B 3/02; D05B 3/025; D05B 55/14; D05B 57/30; D05B 59/02; D05B 59/10
See application file for complete search history.

(56) References Cited

U.S. PATENT DOCUMENTS

| | | | | |
|---|---|---|---|---|
| 155,932 | A | 10/1874 | Drake | |
| 4,373,458 | A * | 2/1983 | Dorosz | D05B 51/00 112/470.06 |
| 4,557,206 | A | 12/1985 | Iwase | |
| 4,787,326 | A | 11/1988 | Scholl et al. | |
| 5,090,342 | A | 2/1992 | Conte | |
| 5,875,726 | A | 3/1999 | Keilmann | |
| 7,966,956 | B2 | 6/2011 | Suzuki et al. | |

(Continued)

FOREIGN PATENT DOCUMENTS

| | | |
|---|---|---|
| DE | 3632046 A1 | 4/1988 |
| DE | 4431318 A1 | 3/1996 |

(Continued)

OTHER PUBLICATIONS

International Search Report and Written Opinion Application No. PCT/US2019/060926; dated Mar. 26, 2020; pp. 12.

(Continued)

*Primary Examiner* — Nathan E Durham
(74) *Attorney, Agent, or Firm* — Cantor Colburn LLP

(57) ABSTRACT

A sewing machine for sewing a stitch into an article is provided. The sewing machine includes a support structure, a first head and a second head. The first head is coupled to the support structure and includes a coupler contained within a second actuator assembly and 360° rotatable relative to the support structure and a first stitching element rotatable with the coupler and translatable via a first actuator assembly relative to the coupler. The second head is coupled to the support structure and includes a coupler contained within the second actuator assembly and 360° degree rotatable relative to the support structure and a second stitching element rotatable with the coupler via the first actuator assembly.

11 Claims, 4 Drawing Sheets

(56) References Cited

U.S. PATENT DOCUMENTS

| | | | | |
|---|---|---|---|---|
| 8,272,341 | B2 | 9/2012 | Konig et al. | |
| 10,358,754 | B2 | 7/2019 | Sano et al. | |
| 2012/0291683 | A1* | 11/2012 | Lee | D05B 21/00 112/470.05 |
| 2018/0080155 | A1* | 3/2018 | Sano | D05B 29/06 |
| 2018/0313012 | A1 | 11/2018 | Kallenbach et al. | |

FOREIGN PATENT DOCUMENTS

| | | | |
|---|---|---|---|
| EP | 2189564 | A1 | 5/2010 |
| JP | 2018042882 | A | 3/2018 |
| KR | 20130054149 | A | 5/2013 |
| KR | 101949888 | B1 | 2/2019 |

OTHER PUBLICATIONS

IPRP Application No. PCT/US2019/060926; dated Jun. 3, 2021; pp. 7.

Office Action issued in Chinese Patent Application No. 201980076906.2; Application Filing Date Nov. 12, 2019; dated Apr. 26, 2022 (8 pages).

Search Report issued in European Application No. 19886558.6; Application Filing Date Nov. 12, 2019; dated Jul. 18, 2022 (9 pages).

* cited by examiner

SEWING MACHINE

CROSS REFERENCE TO RELATED APPLICATION

This application claims the priority of the U.S. Provisional Patent Application No. 62/770,422, filed Nov. 21, 2018, which is incorporated herein by reference in its entirety.

BACKGROUND

The following description relates to sewing machines and, more specifically, to a sewing machine with fully rotatable sewing heads.

Currently, application of a decorative live stitch to pre-shaped automotive components can be accomplished via manual or automated stitching methods. Manual stitching is normally utilized on smaller components with relatively linear stitch paths. As part size, weight and stitch path complexity increase, it becomes more difficult for an operator to manually articulate the pre-shaped part under a stationary sewing machine and thus automation becomes more practical. An automated cell using a six-axis robot is commonly utilized with a sewing machine as the end effector. The sewing machine is designed to access required areas of the part within the range of motion of the robot.

As the trend to apply live stitching to pre-shaped automotive components continues to gain in popularity, the placement and type of stitching required is evolving as well. As the desired stitch path increases in length and/or covers a larger portion of the shaped part surface, additional movement of the sewing head around the outside of the part is required. Movement the sewing head around the outside of the part can present a problem when fixturing the part, however, and the movement can often exceed a range of motion of the robot as well. In addition, automotive manufacturers often prefer unique stitch types, patterns and thread sizes that are not easily provided by conventional sewing systems.

BRIEF DESCRIPTION

According to an aspect of the invention, a sewing machine for sewing a stitch into an article is provided. The sewing machine includes a support structure, a first head and a second head. The first head is coupled to the support structure and includes a coupler contained within a second actuator assembly and 360° rotatable relative to the support structure and a first stitching element rotatable with the coupler and translatable via a first actuator assembly relative to the coupler. The second head is coupled to the support structure and includes a coupler contained within the second actuator assembly and 360° degree rotatable relative to the support structure and a second stitching element rotatable with the coupler via the first actuator assembly.

In accordance with additional or alternative embodiments, the support structure includes a spine and first and second elongate members extending from the spine, the first and second elongate members having distal ends to which the first and second stitching elements are coupled, respectively.

In accordance with additional or alternative embodiments, the first stitching element includes a needle and the second stitching element includes a looper.

In accordance with additional or alternative embodiments, the first head includes a first actuator assembly to drive translation of the first stitching element relative to the coupler and rotation of the second stitching element and a second actuator assembly to drive rotations of the first and second heads.

In accordance with additional or alternative embodiments, the actuation assembly includes a motor, a mechanical linkage extending through the support structure and first and second coupling units by which the mechanical linkage is coupled to the first and second stitching heads.

In accordance with additional or alternative embodiments, an additional drive assembly drives rotations of the support structure.

In accordance with additional or alternative embodiments, a robot controller is configured to control respective translations of the first and second stitching heads and operations of the drive assemblies.

In accordance with additional or alternative embodiments, the robot controller adjusts the predefined stitch path coordinates upon receipt of feedback prior to sewing from a scanner which scan positions of a feature on the article located along the length of the path to be sewn.

According to another aspect of the invention, a sewing machine for sewing a stitch into an article is provided. The sewing machine includes first and second heads, which are each movable relative to the article, a first head and a second head. The first head includes a coupler rotatable about an axis extending through the first and second heads, a first actuator element to rotate with the coupler and to translate relative to the coupler in first and second directions transverse to the axis, a second actuator element to rotate with the coupler, to translate in the first and second directions with the first actuator element and to rotate relative to the first actuator element in a third direction and a third actuator element to rotate with the coupler, to translate in the first and second directions with the first actuator element, to rotate with the second actuator element in the third direction and to translate relative to second actuator element along the axis in the third direction. The second head includes a coupler rotatable about the axis in the third direction, a first actuator element to rotate with the coupler and to translate relative to the coupler in the first and second directions and a second actuator element to rotate with the coupler, to translate in the first and second directions with the first actuator element, to rotate with the first actuator element in the third direction and to translate relative to first actuator element along the axis in the third direction.

In accordance with additional or alternative embodiments, the first head includes first and second stitching elements.

In accordance with additional or alternative embodiments, the first stitching element includes a looper or a spreader and the second stitching element includes a punch or awl.

In accordance with additional or alternative embodiments, the first head includes a first actuation element to drive translations of the first stitching element relative to the coupler of the first head in the first and second directions, a second actuation element to drive rotations of the first stitching element relative to the first actuation element and a third actuation element to drive translations of the second stitching element relative to the first stitching element in the third direction.

In accordance with additional or alternative embodiments, a controller is configured to control and coordinate rotations of the coupler and translations and rotations of stitching elements of each of the first and second heads.

In accordance with additional or alternative embodiments, the controller includes a scanner to scan positions of a feature on the article and is configured correct for deviations between actual and allowable needle positions in accordance with predefined stitching instructions and the positions of the feature.

In accordance with additional or alternative embodiments, a first stitching element of the first head includes a looper or a spreader and a second stitching element of the first head includes a punch or awl.

In accordance with additional or alternative embodiments, a first stitching element of the second head includes a needle.

In accordance with additional or alternative embodiments, the first and second heads are coupled to first and second independently articulable robotic arms.

In accordance with additional or alternative embodiments, the first and second heads are coupled to a support structure.

In accordance with additional or alternative embodiments, the support structure includes a spine and first and second elongate members extending from the spine, the first and second elongate members having distal ends to which the first and second heads are coupled, respectively.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, a sewing machine is provided with capabilities that meet current sewing demands. The sewing machine is intended for use in automated stitching applications and incorporates independent but synchronized upper and lower head rotations to eliminate a need to locate a machine body at a position perpendicular to the sewing path at all times. As a result, an ability to sew closed loop stitch paths is enhanced as is the capability to stitch curves having smaller radii into remote areas of a part. The sewing machine includes sewing heads that are each capable of +/−360° rotation and movement which can be driven mechanically, electro-mechanically or completely electrically. The sewing machine is designed such that the sewing heads are compact in size to allow for maximum maneuverability around a part. Functional capabilities of the machine are enhanced such that the following stitching technologies can be executed with only minor machine reconfiguration: single or double needle double thread chain stitch through soft materials; single or double needle single thread chain stitch through soft materials; single or double needle single thread chain stitch through rigid substrates; and single needle multi-thread embroidery stitching through soft materials. The sewing machine can also be designed such that the sewing heads can be decoupled with upper and lower heads attached to separate robots for further application flexibility.

Figure 1:
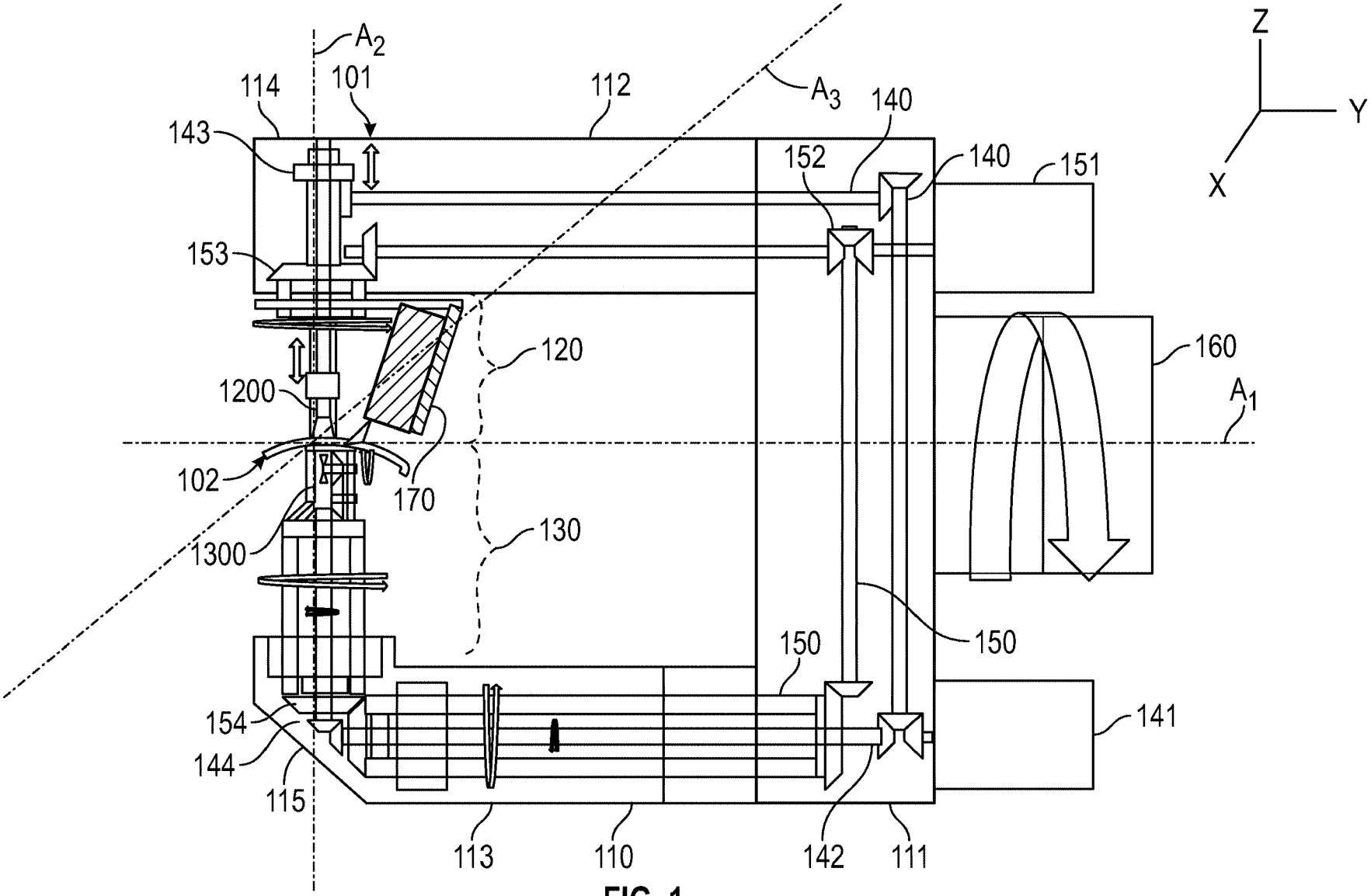
FIG. 1 is a side view of a mechanically driven sewing machine in accordance with embodiments.

With reference to FIG. 1, a sewing machine 101 is provided and is capable of sewing various types of stitches into an article 102. The sewing machine 101 includes a support structure 110, which is movable relative to the article 102 and which is rotatable about an axis A1 that extends through the article 102. The support structure 110 is movable in forward and back directions (i.e., first directions defined axially relative to the axis A3), side to side directions (i.e., second directions defined axially relative to the axis A1) and up and down directions (i.e., third directions defined axially relative to the axis A2).

In accordance with embodiments, the support structure 110 may include a spine 111, a first elongate member 112 extending from a first end of the spine 111 and a second elongate member 113 extending from a second end of the spine 111 to be substantially parallel with the first elongate member 112. The first elongate member 112 has a distal end 114 at its far end from the spine 111 and the second elongate member 113 has a distal end 115 at its far end from the spine 111.

The sewing machine 101 further includes a first stitching head 120, which is coupled to the support structure 110 at the distal end 114 of the first elongate member 112 and a second stitching head 130, which is coupled to the support structure 110 at the distal end 115 of the second elongate member 113. The first stitching head 120 can include or be provided with a first stitching element 1200. The first stitching element 1200 can include a needle. The second stitching head 130 can include or be provided with a second stitching element 1300. The second stitching element 1300 can include a looper.

The sewing machine 101 also includes a first actuation assembly 140, a second actuation assembly 150 and, in some cases, a third actuation assembly 160.

The first actuation assembly 140 is at least partially disposed within the support structure 110 and is configured to actuate sewing element 1200 of the first stitching head 120 and the sewing element 1300 of the second stitching head 130. Actuation of the sewing element 1200 occurs axially along axis A2 while actuation of the sewing element 1300 occurs rotationally about an axis in parallel to axis A1. The first actuation assembly 140 includes a motor 141, a mechanical linkage 142 that extends through the support structure 110, a first coupling unit 143 by which the mechanical linkage 142 is coupled to the first stitching head 120 and a second coupling unit 144 by which the mechanical linkage 142 is coupled to the second stitching head 130. The second actuation assembly 150 is at least partially disposed within the support structure 110 and is configured to drive respective rotations of each of the first stitching head 120 and the second stitching head 130 about axis A2. The second actuation assembly 150 includes a motor 151, a mechanical linkage 152 that extends through the support structure 110, a first coupling unit 153 by which the mechanical linkage 152 is coupled to the first stitching head 120 and a second coupling unit 154 by which the mechanical linkage 152 is coupled to the second stitching head 130.

Where it is available, the third actuation assembly 160 is configured to drive rotations of the support structure 110 about a second axis A1, such that the first stitching head 120 can operate above or below the article 102 and the second stitching head 130 can operate below or above the article 102.

In accordance with further embodiments, the sewing machine 101 may further include a scanner 170 that, prior to sewing, is configured to detect the relative position of a feature on the article 102 located along the stitch path, and provide feedback to the robot controller which in turn will adjust the coordinates of the predefined stitch path prior to sewing, resulting in part sewn in compliance with predefined stitching constraints.

Figure 2:
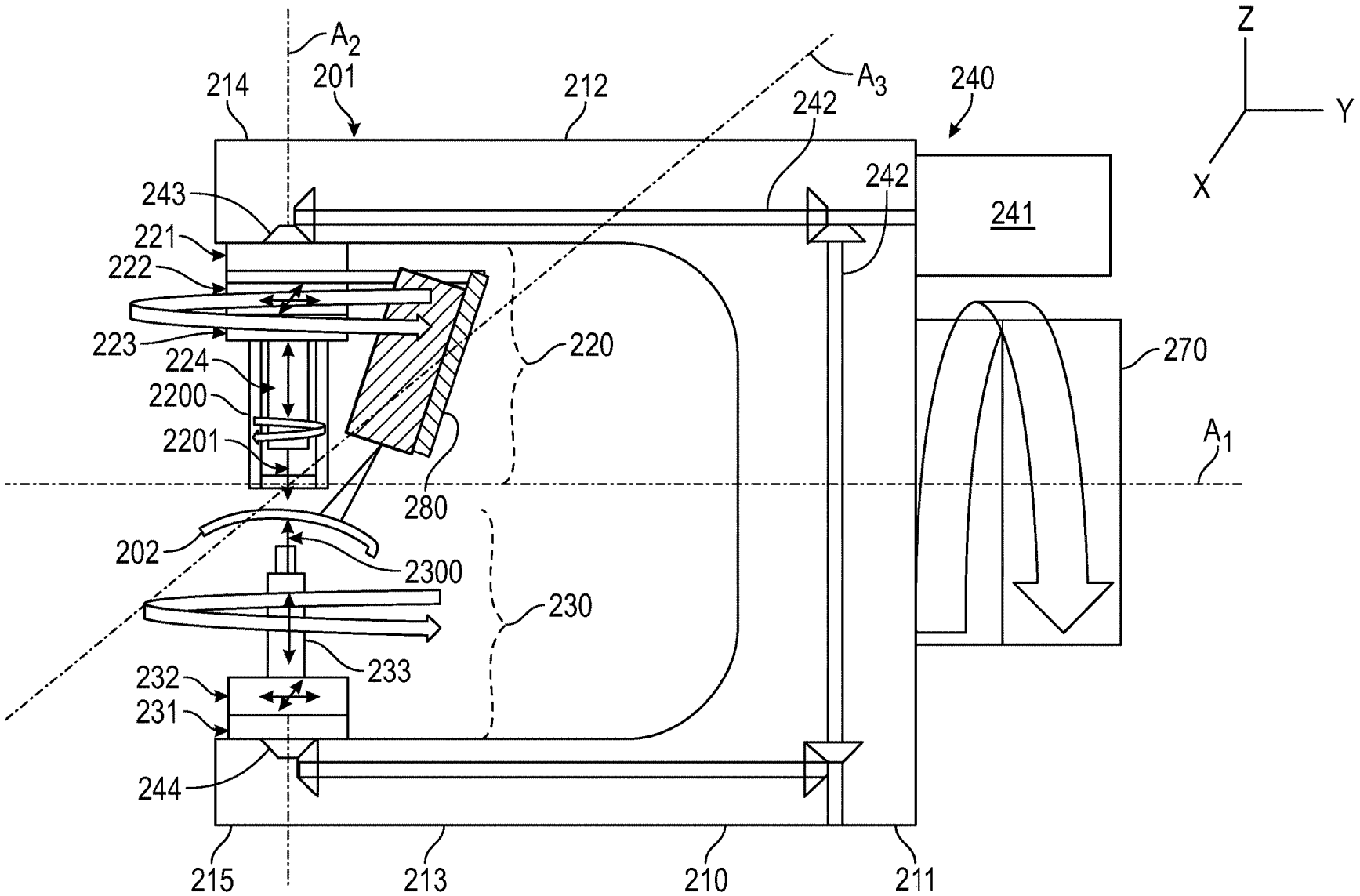
FIG. 2 is a side view of an electrically and mechanically driven sewing machine in accordance with embodiments.

With reference to FIG. 2, a sewing machine 201 is provided for sewing a stitch into an article 202. The sewing machine 201 includes a support structure 210, which is movable relative to the article 202. The support structure 210 is movable in forward and back directions (i.e., first directions defined linearly relative to axis A3), side to side directions (i.e., second directions defined linearly relative to the axis A1) and up and down directions (i.e., third directions defined linearly along the axis A2). The support structure 210 is also rotatable about the axis A1 and the article 202.

In accordance with embodiments, the support structure 210 may include a spine 211, a first elongate member 212 extending from a first end of the spine 211 and a second elongate member 213 extending from a second end of the spine 211 to be substantially parallel with the first elongate member 212. The first elongate member 212 has a distal end 214 at its far end from the spine 211 and the second elongate member 213 has a distal end 215 at its far end from the spine 211.

The sewing machine 201 further includes a first stitching head 220, a second stitching head 230 and a drive assembly 240. The first stitching head 220 is coupled to the support structure 210 at the distal end 214 of the first elongate member 212. The second stitching head 230 is coupled to the support structure 210 at the distal end 215 of the second elongate member 213. The first stitching head 220 can include or be provided with a first stitching element 2200 with an optional second stitching element 2201. The first stitching element 2200 can include a looper or a spreader. The second stitching element 2201 can consist of a punch or awl. The second stitching head 230 can include or be provided with a third stitching element 2300. The third stitching element 2300 can include a needle.

The first stitching head 220 includes a coupler 221, a first actuator element 222, which is rotatable with coupler 221 about axis A2 and which is translatable relative to the coupler 221 in the first and second directions, a second actuator element 223 and an optional third actuator element 224. The second actuator element 223 is translatable with the first actuator element 222 in the second and first directions along axes A1 and A3, is rotatable relative to the first actuator element 222 about axis A2 and is also rotatable with coupler 221 about the axis A2. The optional third actuator element 224 translates the second stitching element 2201 relative to second actuator element 223 in the third direction along the axis A2, is translatable with the first actuator element 222, is rotatable with the second actuator element 223 about the axis A2 and is also rotatable with the coupler 221 about the axis A2.

The second stitching body 230 includes a coupler 231, a first actuator element 232, which is rotatable with coupler 231 about the axis A2 and which is translatable relative to the coupler 231 in the first and second directions along axes A3 and A1, and a second actuator element 233. The second actuator element 233 is translatable with the first actuator element 232 in the second and first directions along axes A1 and A3, is translatable relative to the first actuator element 232 in the third direction along the axis A2 and is rotatable with the coupler 231 about axis A2.

The drive assembly 240 is at least partially disposed within the support structure 210 to drive rotations of the first and second stitching heads 220 and 230 about the axis A2. The actuation assembly 240 includes a motor 241, a mechanical linkage 242 that extends through the support structure 210, a first coupling unit 243 by which the mechanical linkage 242 is coupled to the first stitching head 220 and a second coupling unit 244 by which the mechanical linkage 242 is coupled to the second stitching head 230.

An additional drive assembly 270 is provided to drive rotations of the support structure 210 about the axis A1 during sewing. The additional actuation assembly 270 is also utilized to drive the rotations of the support structure 210 about the second axis A2 such that the first stitching head 220 can operate above or below the article 202 and the second stitching head 230 can operate below or above the article 202.

In accordance with further embodiments, the sewing machine 201 may further include a scanner 280 that, prior to sewing, is configured to detect the relative position of a feature on the article 202 located along the stitch path, and provide feedback to the robot controller which in turn will adjust the coordinates of the predefined stitch path prior to sewing, resulting in part sewn in compliance with predefined stitching constraints.

Figure 3:
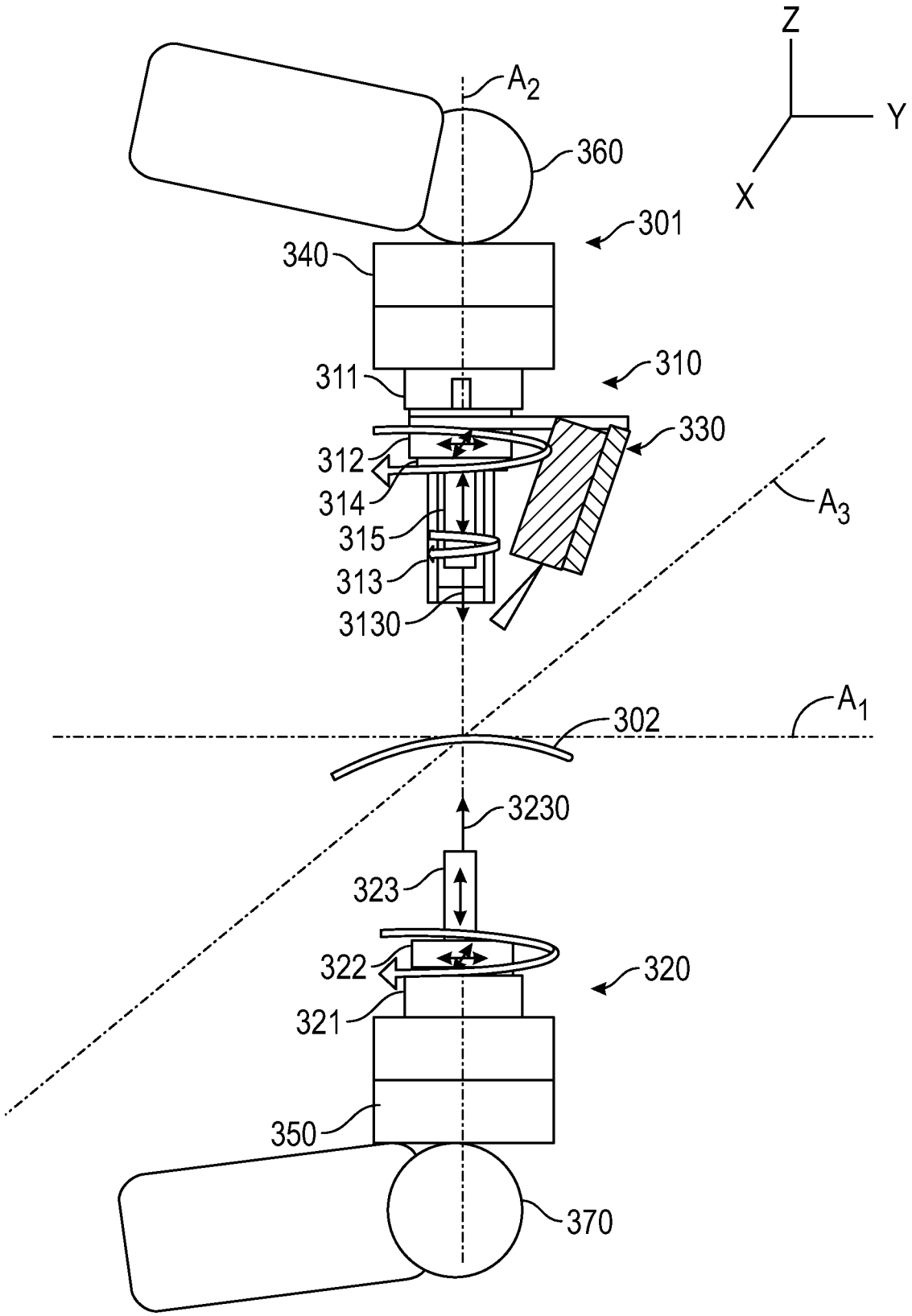
FIG. 3 is a side view of an electrically driven sewing machine in accordance with embodiments.

With reference to FIG. 3, a sewing machine 301 is provided for sewing a stitch into an article 302. The sewing machine 301 includes a first head 310, which is movable relative to the article 302, and a second head 320, which is movable relative to the article 302.

The first head 310 includes a first actuator element 311, which is rotatable about an axis A2 extending through the article 302 and the first and second heads 310 and 320, a second actuator element 312, a third actuator element 314, a fourth actuator element 315, and a first stitching element 313 that includes a looper or a spreader. The second actuator element 312 rotates with the first actuator element 311 and is translatable relative to the first actuator element 311 in first and second directions along axes A3 and A1 directions. The third actuator element 314, which is directly coupled to the first stitching element 313, rotates with the first actuator element 311, is translatable with the second actuator element 312 and rotates relative to the second actuator element 312. The fourth actuator element 315 translates optional second stitching element 3130 in the third direction along the axis A2, rotates with the first actuator element 311, translates with second actuator element 312 and rotates with the third actuator element 314.

The second head 320 includes a first actuator element 321, which is rotatable about the axis A2, a second actuator element 322 and a third actuator element 323. The second actuator element 322 rotates with the first actuator element 321 and is translatable relative to the first actuator element 321 in the first and second directions along the axes A3 and A1. The third actuator element 323 includes a third stitching element 3230 and rotates with the first actuator element 321, translates in the first and second directions along axes A3 and A1 with the second actuator element 322 and is translatable relative to the second actuator element 322 in the third direction along the axis A2.

In accordance with further embodiments, the sewing machine 301 may further include a scanner 330 that, prior to sewing, is configured to detect the relative position of a feature on the article 302 located along the stitch path, and provide feedback to the robot controller which in turn will adjust the coordinates of the predefined stitch path prior to sewing, resulting in part sewn in compliance with predefined stitching constraints.

As shown in FIG. 3, the sewing machine 301 may be connected, via tool changers 340 and 350, to first and second independently articulable robotic arms 360 and 370 to which the first and second heads 310 and 320 are coupled, respectively. The robotic arms 360 and 370 can allow the first and second heads 310 and 320 to operate at various positions and attitudes relative to the article 302 and to be disposed above or below the article 302.

Figure 4:
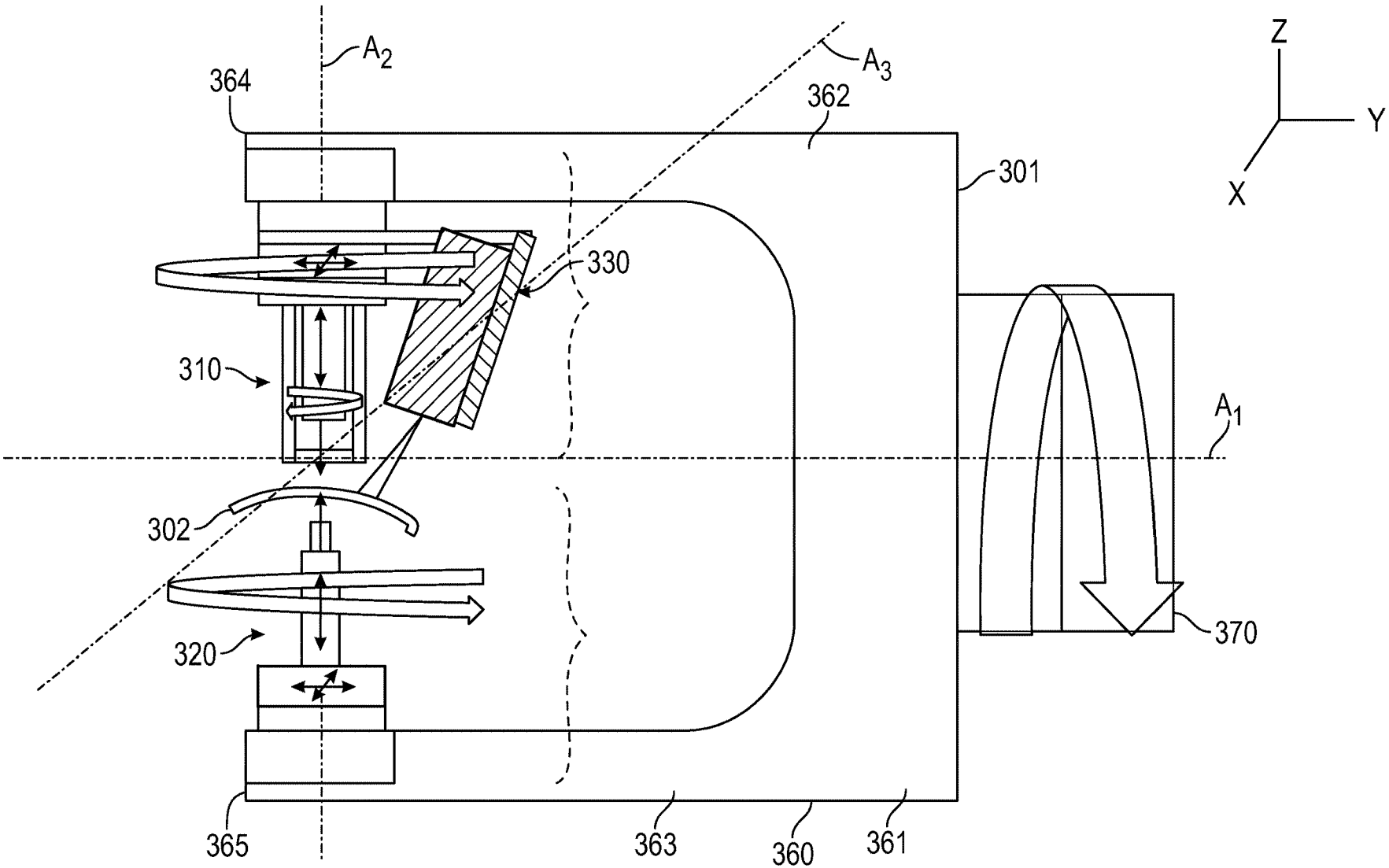
FIG. 4 is a side view of the sewing machine of FIG. 3 with a support structure in accordance with embodiments.

With reference to FIG. 4, the first and second heads 310 and 320 can be coupled to a support structure 360. The support structure 360 may include a spine 361, a first elongate member 362 extending from a first end of the spine 361 and a second elongate member 363 extending from a second end of the spine 361 to be substantially parallel with the first elongate member 362. The first elongate member 362 has a distal end 364 to which is the first head 310 is coupled at its far end from the spine 361 and the second elongate member 363 has a distal end 365 to which the second head 320 is coupled at its far end from the spine 361.

Additional drive assembly 370 is provided to drive rotations of the support structure 360 about axis A1, as required in order to position the sewing machine 301 in it optimal position for stitching. The robot controller can be configured to drive the rotations of the support structure 360 about the axis A1 such that the first head 310 can operate above or below the article 302 and the second head 320 can operate below or above the article 302.

Technical effects and benefits of the present disclosure are the provision of a sewing machine incorporating upper and lower sewing heads for use in automated stitching applications to eliminate a need to locate a machine body at a position perpendicular to the sewing path at all times and to enhance an ability to sew closed loop stitch paths and curves having small radii, such as the case when embroidering. In addition, the sewing machine provides for closed loop chain stitch patterns on large contoured parts that have no internal feature openings (which are normally required for sewing head access) as well as start and stop positions that are perfectly aligned to create the effect of multiple components sewn together. The sewing machine also provides for intricate and complex chain stitch patterns that are placed on large countered parts, stitching capabilities around entire perimeter and interior portions of such products (where the products contains minimal or no openings internal to the part for sewing head access) and patterns that can be programmed to create an image, logo or text on products (embroidery) requiring very tight directional changes and turning radii (e.g., in-plane turning radii or the stitch turning radius on the surface of the flat or contoured part of less than 5 mm and in some cases less than 2 mm) where the turning radii is dictated by stitch length and an ability to rotate/turn the needle and hook within short periods of time and over short distances.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A sewing machine for sewing a stitch into an article, the sewing machine comprising:

first and second heads, which are each movable relative to the article, the first head comprising:

a coupler rotatable about an axis extending through the first and second heads;

a first actuator element to rotate with the coupler and to translate relative to the coupler in first and second directions transverse to the axis;

a second actuator element to rotate with the coupler, to translate in the first and second directions with the first actuator element and to rotate relative to the first actuator element about the axis; and a third actuator element to rotate with the coupler, to translate in the first and second directions with the first actuator element, to rotate with the second actuator element about the axis and to translate relative to second actuator element along the axis in a third direction; and the second head comprising:

a coupler rotatable about the axis in the third direction;

a first actuator element to rotate with the coupler and to translate relative to the coupler in the first and second directions; and a second actuator element to rotate with the coupler, to translate in the first and second directions with the first actuator element, to rotate with the first actuator element about the axis and to translate relative to first actuator element along the axis in the third direction.

2. The sewing machine according to claim 1, wherein the first head comprises first and second stitching elements.

3. The sewing machine according to claim 2, wherein the first stitching element comprises a looper or a spreader and the second stitching element comprises a punch or awl.

4. The sewing machine according to claim 3, wherein, for the first head:

the first actuator element drives translations of the first stitching element relative to the coupler of the first head in the first and second directions;

the second actuator element drives rotations of the first stitching element relative to the first actuation element; and the third actuator element drives translations of the second stitching element relative to the first stitching element in the third direction.

5. The sewing machine according to claim 2, further comprising a controller configured to control and coordinate rotations of the coupler and translations and rotations of stitching elements of each of the first and second heads.

6. The sewing machine according to claim 5, further comprising a scanner configured to scan a feature located along a part stitch path on the part and provide feedback to the controller to correct for deviations between scanned and programmed needle positions of a preprogrammed sewing path.

7. The sewing machine according to claim 2, wherein a first stitching element of the second head a needle.

8. The sewing machine according to claim 2, further comprising first and second independently articulable robotic arms to which the first and second heads are coupled.

9. The sewing machine according to claim 2, further comprising a support structure to which the first and second heads are coupled.

10. The sewing machine according to claim 9, wherein the support structure comprises:

a spine; and first and second elongate members extending from the spine, the first and second elongate members having distal ends to which the first and second heads are coupled, respectively.

11. The sewing machine according to claim 1, wherein a first stitching element of the first head comprises a looper or a spreader and a second stitching element of the first head comprises a punch or awl.

* * * * *